United States Patent [19]

Gross

[11] Patent Number: 4,466,887

[45] Date of Patent: Aug. 21, 1984

[54] POLYMER COLLECTORS FOR COAL FLOTATION

[75] Inventor: Anthony E. Gross, Clarendon Hills, Ill.

[73] Assignee: Nalco Chemical Company, Oak Brook, Ill.

[21] Appl. No.: 512,253

[22] Filed: Jul. 11, 1983

[51] Int. Cl.[3] ..... B03D 1/14

[52] U.S. Cl. ..... 209/166; 252/61; 210/704

[58] Field of Search ..... 209/166, 167; 252/61; 210/704, 705

[56] References Cited

U.S. PATENT DOCUMENTS 4,222,862 9/1980 Finch ..... 209/166
4,263,148 4/1981 Symens et al. ..... 210/705

FOREIGN PATENT DOCUMENTS 355986 11/1972 U.S.S.R. ..... 209/166

*Primary Examiner*—Bernard Nozick
*Attorney, Agent, or Firm*—John G. Premo; Robert A. Miller; Donald G. Epple

[57] ABSTRACT

A method of increasing the yield of coal undergoing a concentration treatment of froth flotation by using as the collector an alkyl phenol formaldehyde condensate product having 4–5 phenolic nuclei with the alkyl group of said phenol having between 4–15 carbon atoms.

3 Claims, No Drawings

POLYMER COLLECTORS FOR COAL FLOTATION

INTRODUCTION

As is known, flotation is a process for separating finely ground minerals such as coal particles from their associate waste or gangue by means of the affinity of surfaces of these particles for air bubbles, which is a method for concentrating coal particles. In the flotation process a hydrophobic coating is placed on the particles which acts as a bridge so that the particles may attach to the air bubble and be floated, since the air bubble will not normally adhere to a clean mineral surface such as coal.

In froth flotation of coal, a froth is formed as aforesaid by introducing air into a so-called pulp which contains the impure finely divided coal particles and water containing a frothing agent. The flotation separation of coal from the residue or gangue depends upon the relative wettability of surfaces and the contact angle, which is the angle created by the solid air bubble interface.

In the development of flotation to date, three general classes of reagents have been utilized:

(1) collectors or promoters,
(2) modifiers, and
(3) frothers.

The promoters consist almost exclusively in this art of kerosene and fuel oil.

Modifiers are such regulating agents as pH regulators, activators, depressants, dispersants, and flocculants.

A frothing agent is utilized to provide a stable flotation froth persistent enough to facilitate the coal separation but not so persistent that it cannot be broken to allow subsequent handling. Examples of commonly used frothing agents are pine oil, creosote, cresylic acid, and alcohols such as 4-methyl-2-pentanol. Alcohol frothers are preferred in the present invention and additional alcohols are illustrated by amyl and butyl alcohols, terpeneol and cresols. An additional preferred alcohol is methyl isobutylcarbinol (MIBC) which is an aliphatic alcohol in common use as a frother.

For a more detailed description of coal flotation operation, see the following reference work: D. J. Brown, Chapter 20, "Coal Flotation," pages 518–537.

A common collector used for the flotation of coal particles is a hydrocarbon liquid such as fuel oil. Other collectors are known and are described in the literature.

THE INVENTION

The present invention is directed to an improved collecting agent for coal flotation operations.

The invention comprises a method of increasing the yield of coal undergoing a concentration treatment of froth flotation by using as the collector an alkyl phenol formaldehyde condensate product having 4–15 phenolic nuclei with the alkyl group of said phenol having between 4–15 carbon atoms. In a preferred embodiment, the dosage of the collector is within the range of 0.05–1 pound of collector per ton of dry coal.

The alkyl phenol used to prepare the condensation product preferably is a nonyl phenol.

The Phenol-Formaldehyde Condensation Products

The phenol formaldehyde condensation products are prepared by reacting formaldehyde or a substance which breaks down to formaldehyde under the reaction conditions, e.g., paraformaldehyde and trioxane, and a difunctional, monoalkyl phenol, such as a substantially pure ortho- or para-monoalkyl phenol or a crude alkyl phenol consisting of at least 75% difunctional phenol, by heating the reactants in the presence of a small amount of acid catalysts such as sulfamic acid. The aqueous distillate which begins to form is collected and removed from the reaction mixture. After several hours of heating at temperatures slightly above the boiling point of water, the mass becomes viscous and is permitted to cool to about 100° to 105° C. At this point a suitable hydrocarbon fraction is added, and heating is resumed. Further aqueous distillate begins to form and heating is continued for an additional number of hours until at least about one mol of aqueous distillate per mol of reactants has been secured. The product is permitted to cool to yield the phenol-formaldehyde condensation product in a hydrocarbon solvent. The molecular weight of these intermediate condensation products cannot be ascertained with certainty, but we would approximate that they contain about 3 to 15 phenolic nuclei per resin molecule. The solubility of the condensation product in hydrocarbon solvents such as $SO_2$ extract would indicate that the resin is a linear type polymer, thus distinguishing them from the more common phenol-formaldehyde resins of the cross-linked type.

A method of preparing resins of the type described above is set forth in U.S. Pat. No. 3,244,770, the disclosure of which is incorporated herein by reference.

The improved collectors of the invention are normally used in combination with frothing agents and emulsifiers which produces water-in-oil emulsions of such combined products. While the phenol formaldehyde resins of the invention are excellent collecting agents when used alone, when formulated with other materials such as frothers and promoters, they may be combined with other known collecting agents such as, for example, the No. 2 Fuel Oil.

A typical formula in the prior art using a conventional No. 2 Fuel Oil collector is set forth below as Formula A.

Formula A

| Ingredients | % by Weight |
|---|---|
| 2 ethyl hexanol | 38.4 |
| #2 Fuel Oil | 46.8 |
| Water-in-Oil Emulsifying Agent comprising nonyl phenol reacted with 3 moles of ethylene oxide | 5.2 |
| Frother | 9.6 |

A typical formula of the invention is set forth below as Formula B.

Formula B

| Ingredients | % by Weight |
|---|---|
| 2 ethyl hexanol | 48.0 |
| #2 Fuel Oil | 28.8 |
| Water-in-Oil Emulsifying Agent comprising nonyl phenol reacted with 3 moles of ethylene oxide | 3.2 |
| Nonyl phenol formaldehyde condensation polymer having a molecular weight within the range of 1800–2000 (phenol formaldehyde polymer) | 20.0 |

Formulas A and B were tested on a variety of coals with the results being set forth below in the examples.

EXAMPLE 1

| Product | Dose (lb/ton) | Yield (%) | Concentrate Ash (%) | Recovery (%) |
|---|---|---|---|---|
| Formula A | 0.75 | 64.7 | 4.49 | 67.8 |
| | 1.0 | 74.3 | 4.47 | 77.8 |
| Formula B | 0.75 | 76.4 | 4.67 | 79.9 |
| | 1.0 | 80.6 | 4.69 | 84.3 |

EXAMPLE 2

| Product | Dose (lb/ton) | Yield (%) | Concentrate Ash (%) | Recovery (%) |
|---|---|---|---|---|
| Formula A | 0.6 | 62.9 | 7.1 | 75.8 |
| Formula A +06 10% phenol formalde-hyde polymer | 68.4 | 7.9 | 81.5 | |

EXAMPLE 3

| Product | Dose (lb/ton) | Yield (%) | Concentrate Ash (%) | Recovery (%) |
|---|---|---|---|---|
| Formula A | 0.5 | 44.1 | 10.1 | 65.2 |
| | 1.0 | 49.5 | 11.7 | 72.2 |
| | 2.0 | 56.2 | 13.1 | 79.5 |
| Formula B | 0.5 | 47.4 | 10.7 | 85.6 |
| | 1.0 | 55.5 | 13.2 | 79.5 |
| | 2.0 | 62.3 | 15.4 | 85.6 |

| Ingredients | % by Weight |
|---|---|
| **Formula C** | |
| 2 ethyl hexanol | 64.0 |
| #2 Fuel Oil | 14.4 |
| Water-in-Oil Emulsifying Agent comprising nonyl phenol reacted with 3 moles of ethylene oxide | 1.6 |
| Nonyl phenol formaldehyde condensation polymer having a molecular weight within the range of 1800–2000 (phenol formaldehyde polymer) | 29.0 |

EXAMPLE 4

| Product | Dose (lb/ton) | Yield (%) | Concentrate Ash (%) | Recovery (%) |
|---|---|---|---|---|
| Formula A | 0.26 | 52.4 | 9.0 | 61.6 |
| | 0.30 | 57.6 | 9.3 | 67.5 |
| Formula B | 0.26 | 61.5 | 9.7 | 71.8 |
| | 0.30 | 59.2 | 9.2 | 69.5 |
| Formula C | 0.26 | 61.5 | 8.9 | 72.4 |
| | 0.30 | 63.1 | 9.2 | 74.0 |

| Ingredients | % by Weight |
|---|---|
| **Formula D** | |
| 2 ethyl hexanol | 48.0 |
| #2 Fuel Oil | 28.8 |
| Water-in-Oil Emulsifying Agent comprising nonyl phenol reacted with 3 moles of ethylene oxide | 20.0 |

-continued

| Ingredients | % by Weight |
|---|---|
| Nonyl phenol formaldehyde condensation polymer having a molecular weight within the range of 1800–2000 (phenol formaldehyde polymer) | 3.2 |
| **Formula E** | |
| 2 ethyl hexanol | 48.0 |
| #2 Fuel Oil | 19.5 |
| Water-in-Oil Emulsifying Agent comprising nonyl phenol reacted with 3 moles of ethylene oxide | 3.2 |
| Nonyl phenol formaldehyde condensation polymer having a molecular weight within the range of 1800–2000 (phenol formaldehyde polymer) | 29.3 |
| **Formula F** | |
| 2 ethyl hexanol | 35.0 |
| #2 Fuel Oil | 24.4 |
| Water-in-Oil Emulsifying Agent comprising nonyl phenol reacted with 3 moles of ethylene oxide | 4.0 |
| Nonyl phenol formaldehyde condensation polymer having a molecular weight within the range of 1800–2000 (phenol formaldehyde polymer) | 36.6 |
| **Formula G** | |
| 2 ethyl hexanol | 48.0 |
| #2 Fuel Oil | 10.0 |
| Water-in-Oil Emulsifying Agent comprising nonyl phenol reacted with 3 moles of ethylene oxide | 3.2 |
| Nonyl phenol formaldehyde condensation polymer having a molecular weight within the range of 1800–2000 (phenol formaldehyde polymer) | 38.8 |
| **Formula H** | |
| 2 ethyl hexanol | 60.0 |
| #2 Fuel Oil | 14.7 |
| Water-in-Oil Emulsifying Agent comprising nonyl phenol reacted with 3 moles of ethylene oxide | 3.2 |
| Nonyl phenol formaldehyde condensation polymer having a molecular weight within the range of 1800–2000 (phenol formaldehyde polymer) | 22.1 |
| **Formula I** | |
| Pine oil | 50.0 |
| #2 Fuel Oil | 50.0 |
| **Formula J** | |
| Pine oil | 75.0 |
| #2 Fuel Oil | 25.0 |

EXAMPLE 5

| Product | Dose (lbs/t) | Yield (%) | Ash (%) Float | Ash (%) Tail | Recovery (%) |
|---|---|---|---|---|---|
| Formula D | 0.75 | 52.8 | 12.5 | 66.0 | 74.2 |
| | 1.0 | 55.4 | 13.0 | 68.4 | 77.4 |
| | 1.5 | 58.8 | 13.9 | 73.2 | 82.1 |
| Formula E | 0.75 | 55.0 | 12.8 | 68.9 | 77.4 |
| | 1.0 | 58.1 | 13.5 | 72.2 | 81.2 |
| | 1.5 | 61.6 | 15.6 | 70.3 | 82.0 |
| Formula F | 1.0 | 55.5 | 14.6 | 69.4 | 77.6 |
| | 1.5 | 60.4 | 16.2 | 74.4 | 83.3 |
| Formula G | 1.0 | 59.6 | 14.1 | 74.5 | 83.2 |
| | 1.5 | 62.5 | 14.4 | 74.9 | 84.8 |
| Formula H | 1.0 | 57.3 | 13.1 | 70.3 | 79.7 |
| | 1.5 | 62.1 | 14.4 | 74.9 | 84.8 |
| Formula I | 0.75 | 40.4 | 11.4 | 56.9 | 58.3 |
| | 1.0 | 41.8 | 11.6 | 58.0 | 60.2 |
| | 1.5 | 49.3 | 12.3 | 63.1 | 69.8 |
| | 2.0 | 49.2 | 12.7 | 63.0 | 69.6 |
| Formula J | 1.0 | 43.2 | 12.6 | 58.9 | 61.9 |
| | 1.5 | 47.2 | 10.1 | 62.5 | 68.1 |

In each of the above examples, the coals were from a different source, thus illustrating the versatility of the invention.

Having thus described my invention, I claim as follows:

1. A method of increasing the yield of coal undergoing a concentration treatment of froth flotation by using as the collector an alkyl phenol formaldehyde condensate product having 4–15 phenolic nuclei with the alkyl group of said phenol having between 4–15 carbon atoms in the froth flotation to separate coal from the gangue and recover coal with the froth.

2. The method of claim 1 where the alkyl phenol is nonyl phenol.

3. The method of claim 1 where the dosage of the collector is within the range of 0.05–1 pound of collector per ton of dry coal.

* * * * *